US006003824A

United States Patent [19]

Peterson et al.

[11] Patent Number: 6,003,824

[45] Date of Patent: Dec. 21, 1999

[54] METHOD OF HANGING A CLAY FLOWERPOT

[76] Inventors: Robert E. Peterson, 12329 Pinewood Dr., Omaha, Nebr. 68144; George W. Peterson, 9235 Pioneers Ct., Lincoln, Nebr. 68520

[21] Appl. No.: 08/286,696

[22] Filed: Aug. 5, 1994

[51] Int. Cl.[6] ..... A47K 1/08

[52] U.S. Cl. ..... 248/312.1; 47/67 R

[58] Field of Search ..... 248/312.1, 311.2, 248/310; 47/39, 39 C, 67 R; 211/71, 88

[56] References Cited

U.S. PATENT DOCUMENTS

| | | | |
|---|---|---|---|
| 2,967,691 | 1/1961 | Lehnbeuter et al. | 248/312.1 |
| 4,841,671 | 6/1989 | Reed | 47/67 R |
| 5,074,504 | 12/1991 | Minnick | 47/67 R X |
| 5,405,116 | 4/1995 | Shepherd et al. | 248/312.1 |

*Primary Examiner*—Ramon O. Ramirez
*Assistant Examiner*—Stephen S. Wentsler
*Attorney, Agent, or Firm*—Vincent L. Carney

[57] ABSTRACT

To hang a clay flowerpot and saucer to a fence post, porch or the like, an elongated base of a hanger is mounted to a surface, a saucer is mounted to the hanger in a saucer holder in an upright position and a flowerpot is mounted to the same hanger in a flowerpot holder above the saucer and the saucer holder is positioned, after which the saucer holder is fastened in place. The saucer holder is removably fastenable to said base in a horizontal slot so that it can be moved upwardly and downwardly. The holder for the saucer includes means for gripping the edge of a saucer between a downwardly extending tongue and a slanting surface.

1 Claim, 4 Drawing Sheets

METHOD OF HANGING A CLAY FLOWERPOT

BACKGROUND OF THE INVENTION

This invention relates to hangers for flowerpots or other containers intended to hold plants.

Under some circumstances, flowers and other plants are grown in pots that are attached to preexisting structures such as fences, porch walls or the like by fasteners such as belts passing around fence posts, screws, nails or the like. One class of hanger for such flowerpots includes an elongated base having apertures through it and a clip extending from the front side. The clip is adapted to receive and support the flowerpot and the apertures on the back receive fasteners for holding the hanger to the preexisting structures.

To support the flowerpot in this class of hanger, the clip includes two outwardly extending substantially horizontal members extending from the base and positioned vertically one under the other with the top member having a vertically oriented downwardly-extending projection or tongue spaced with respect to the bottom horizontal member so that: (1) the inner surface of the projection facing the base rests against the upper inside edge of a flowerpot; and (2) the bottom horizontal member receives a shoulder of the flowerpot rim on its upper surface and receives the inwardly slanting outer walls on its distal surface. The distal end of the bottom horizontal member has its surface at an angle such as that customary for clay flowerpots. With this arrangement, the two parallel horizontally-extending members together support the flowerpot.

In a prior art hanger of this class, the base of the hanger is relatively short vertically and does not include any support for a saucer so the bottom of the flowerpot is fully exposed.

The prior art flowerpot hangers of this class have several disadvantages, such as for example: (1) the flowerpots held by it drain quickly and thus need water more often; (2) the drainage from the flowerpot may drip onto a porch surface or the like; (3) water cannot be placed in a saucer and permitted to move to the plant by capillary action; and (4) they do not have the added decorative feature of a saucer under the flowerpot.

SUMMARY OF THE INVENTION

Accordingly, it is an object of the invention to provide a novel hanger for flowerpots or other containers.

It is a still further object of the invention to provide a novel method of hanging flower or plant containers.

It is a still further object of the invention to provide a novel method of making hangers for flowerpots.

It is a still further object of the invention to provide a convenient technique for mounting flowerpots having both a pot and a saucer in combination.

In accordance with the above and further objects of the invention, a hanger for flowerpots or other containers intended to hold plants includes an elongated base, a holder for removably fastening the flowerpot to the base spaced a substantial distance from the bottom of the flowerpot and from the bottom of the base of the hanger and a holder for removably fastening a saucer spaced an adjustable distance from the flowerpot holder to permit ready mounting of both a flowerpot and a saucer vertically one under the other.

In the preferred embodiment, the distance between the top holder for the flowerpot and the bottom holder for the saucer is adjustable because the bottom holder is mounted within a vertical slot so that it can be fastened at adjustable distances.

However, other means can be used for such adjustability and either the top holder or the bottom holder or both may be movable on the base of the hanger.

In use, a flowerpot is hung in the upper holder and a saucer is hung in the bottom holder. The saucer is then slid upwardly and a mark is made when the bottom of the saucer is adjacent to the bottom of the flowerpot. The saucer is then lowered and the flowerpot and saucer are removed from the holders. The bottom holder is then fastened in place where indicated by the mark, the saucer is again hung onto the saucer holder and the flowerpot is then again hung on the flowerpot holder.

In making the hanger, the base and upper pot holder of the hanger are formed of plastic by injection molding. The die cavity is elongated and generally rectangular and includes die parts to form the openings for mounting the base and the slot for the adjustable bottom saucer holder. The second die part includes a die piece of smaller rectangular dimensions near the upper portion of the cavity of the first die part that forms an opening in the base and shapes a downwardly extending upper member forward of the opening and of the same size.

The lower saucer holder is formed by separate die cavities to have at least one boss sized to fit in the slot of the base extending rearwardly to provide stability within the slot. The portion of the die cavity for the boss is substantially the same width as the slot and the cavity for the bottom holder is substantially the same with of the base.

From the above description, it can be understood that the hanger of this invention has several advantages, such as for example: (1) it is adjustable for different sizes of flowerpots and saucers; (2) it is convenient to mount both the flowerpot and the saucer; and (3) it is inexpensively formed.

SUMMARY OF THE DRAWINGS

The above noted and other features of the invention will be better understood from the following detailed description when considered with reference to the accompanying drawings, in which.

DETAILED DESCRIPTION

Figure 1:
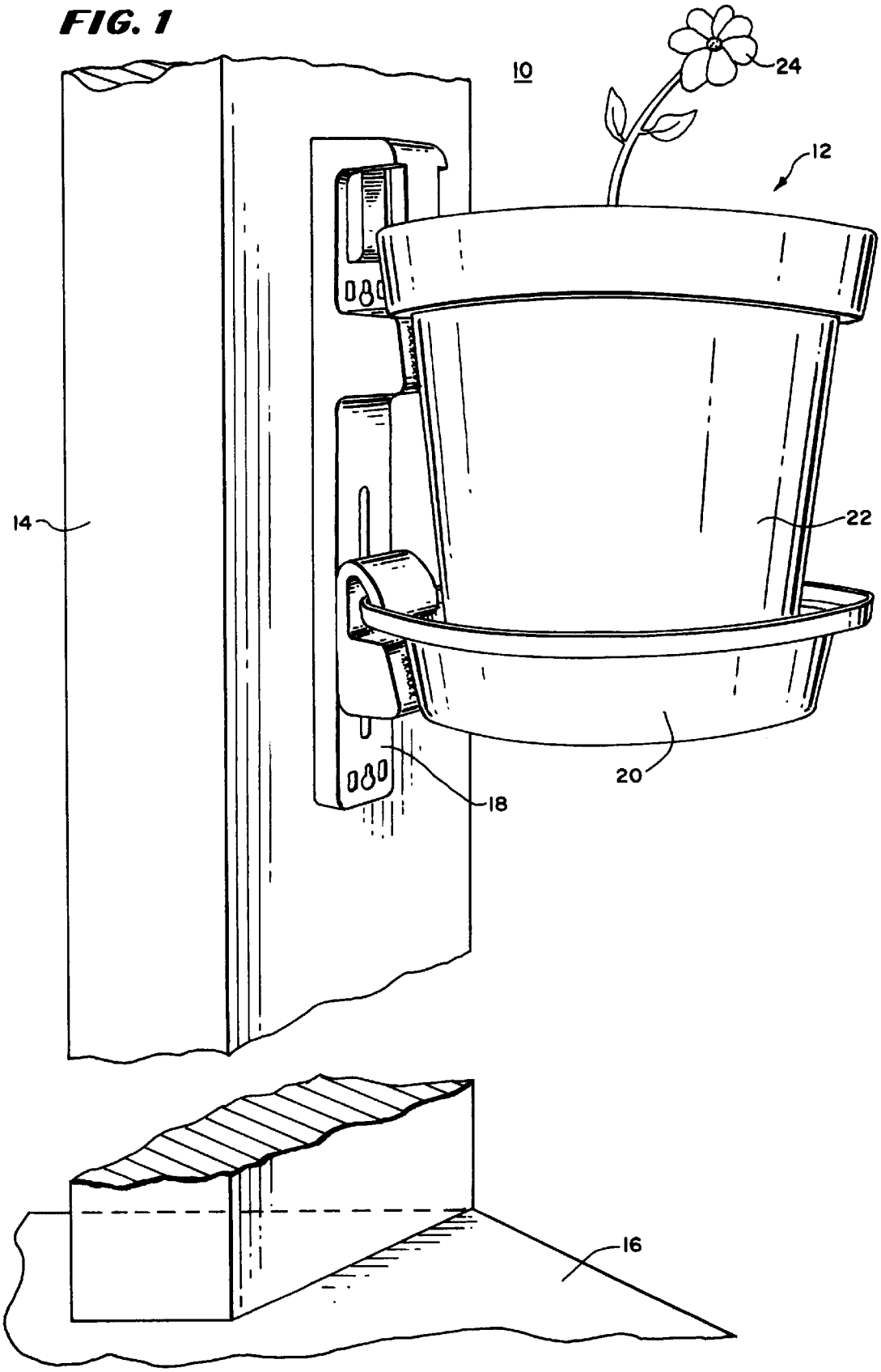
FIG. 1 is a fragmentary, simplified, perspective view of a hanger in accordance with the invention positioned to mount a flowerpot or other container to a pole.

In FIG. 1, there is shown a fragmentary perspective simplified view of a combination 10 of mounting system 12 for potted plants support 14 for the mounting system 12. The support 14 may be any suitable structure such as a fence, separate post, or a part of a porch of a house and may itself be mounted in a support such as the ground 16 in the case of a fence or post.

The mounting system 12 includes a plant hanger 18, a saucer 20 for the plant hanger 18, a flowerpot 22 for holding the plant and the plant itself 24. The plant hanger 18 is adapted to be mounted by a wood screw or by a belt to any structure such as a fence or post on a porch or the like and to hold a plant flowerpot with a saucer positioned underneath the plant flowerpot.

Flowerpot in this specification means any suitable container for holding plants such as a clay flowerpot or the like and saucer in this specification means any construction fitting under the plant flowerpot such as to hold water or catch water draining from the flowerpot. However, the invention will be described in terms of conventional clay flowerpots and saucers normally used for this purpose. The word plant includes normal flowering plants or any other plant but particularly ornamentals which may be grown within a flowerpot.

Figure 2:
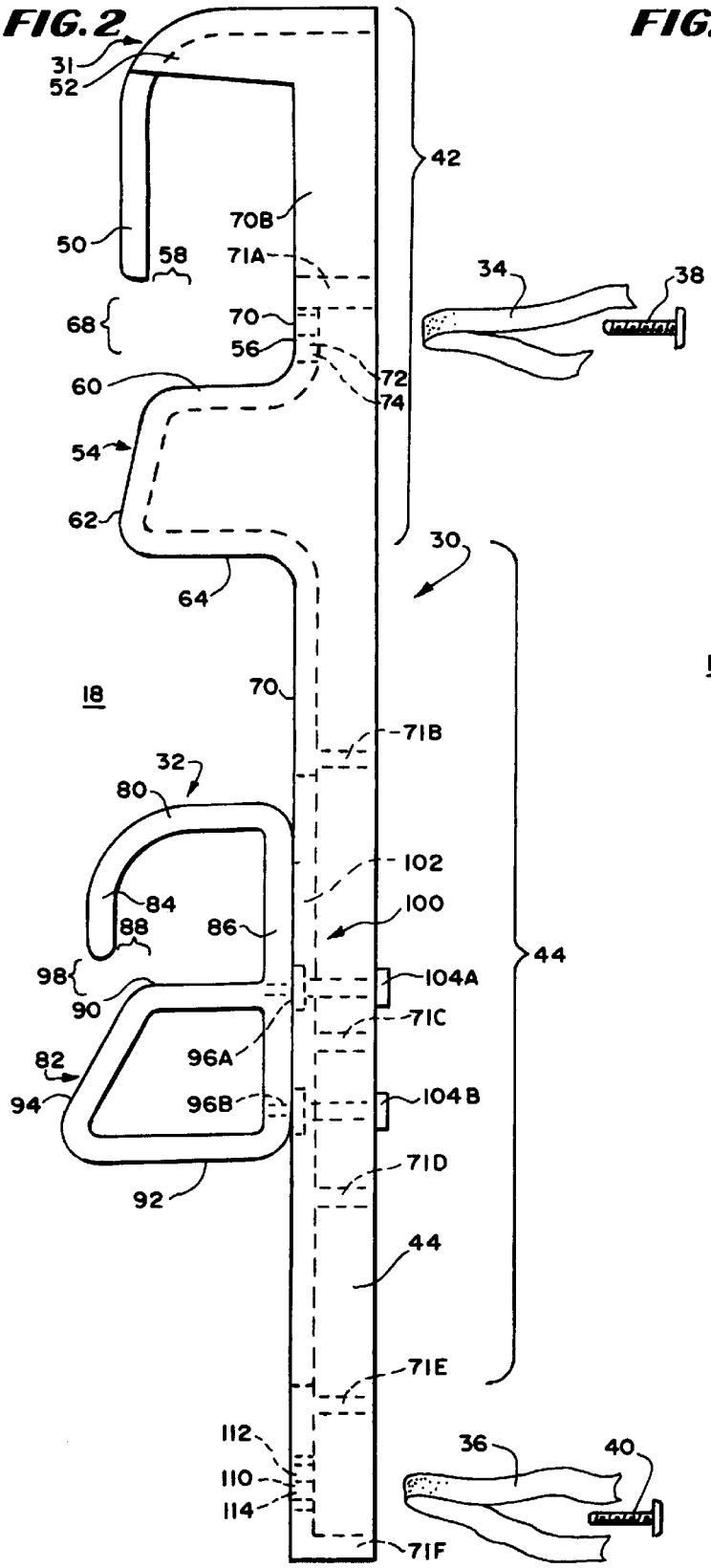
FIG. 2 is a partly-exploded, side elevational view of the embodiment of hanger of FIG. 1.

In FIG. 2, there is shown a side elevational view of a hanger 18 having a hanger base 30, a saucer holder 32 attached to the base 30, and a plurality of fasteners including top and bottom attachment belts or ties 34 and 36 and top and bottom wood screws 38 and 40. The fasteners may be used to fasten the plant hanger 18 to a building or fence structure such as by a wood screw or bolt or the like or by tying the hanger to posts or other vertical relatively small diameter structures. The base includes upon it a flowerpot holder and means permitting the saucer holder to be adjusted in position underneath the flowerpot holder.

The base 30 includes a flowerpot holder section 42 and a saucer holder section 44 with the saucer holder section 44 being integrally formed with the flowerpot holder section 42 and being located immediately below the flowerpot holding section 42 to accommodate the saucer holder 32.

The flowerpot holder section 42 has a flowerpot holder 31 formed upon it including a downwardly extending tongue 50, a top portion 52, a bottom portion 54 and a top and bottom separating section 56. The tongue 50 extends downwardly from the top portion 52 directly over the bottom portion 54 and its distal end is spaced from the lower surface of the top portion 52 and from the upper surface of the bottom portion 54 a sufficient distance to permit the upper edge of the flowerpot 22 (FIG. 1) to fit between the distal end of the tongue 50 and the top surface of the bottom portion 54 and extend upwardly without hitting the lower surface of the top portion 52. The distance between the lower surface of the top portion 52 and the top surface of the bottom portion 54 should be sufficient so that the shoulder of the flowerpot 22 (FIG. 1) rests upon the upper surface of the bottom portion 54 with the flowerpot 22 being held in its normal horizontal position with respect to the ground.

The bottom portion 54 of the clay flowerpot holder 31 includes a top surface 60, a bottom surface 64 and a joining slant surface 62 joining the top surface 60 and the bottom surface 64. The bottom portion 54 of the holder 31 extends forwardly in the same direction as the top portion 52 from the hanger base 30 and is: (1) below the distal end of the downwardly extending tongue or projection 50 a distance 68; and (2) closer to the base than the tongue 50 but separated from the inner surface of the tongue 50 a distance 58 selected to accommodate the upper rim and shoulder of clay flowerpots and hold them horizontally.

In the preferred embodiment, the distance 68 between a first upper horizontal plane at the distal end of the downwardly extending tongue 50 and a second lower horizonatal plane level with the top surface 60 is 0.75 inches but may be a distance of between 0.8 inches or 0.4 inches as long as it is suitable for holding conventional clay flowerpots in position so that their central vertical axis remains substantially vertical and their bottom is substantially horizontal.

The distance 58 in the preferred embodiment between the inner surface of the tongue 50 facing the separating section 56 and the upper end of the top surface 60 where it joins the slanting surface 62 in the preferred embodiment is one eighth of an inch and the inner surface is one inch from the facing surface of the separating section 56. However, it may be between one sixteenth and one quarter of an inch from the end of the top surface 60 where it begins curving downwardly to the slanting separating surface 62. The downwardly extending tongue 50 must be spaced at least an eighth of an inch from the bottom surface of the top portion 52 and in the preferred embodiment, is one and one half inches from the nearest wall above it. This distance need only be sufficient to receive the upper edge of the clay flowerpot.

The separating section 56 between the top portion 52 and the bottom portion 54 includes right and left walls (70A and 70B, FIG. 4), a generally flat section 70, three apertures 72, 74 and 76 (FIG. 3), a perpendicular support cross wall 71A and a rectangular opening the same size as the downwardly extending tongue 50 and directly above it. The right wall is shown at 70B and the opening is in the generally flat section 70 between a perpendicularly extending portion of the wall and the end portion 52 which is open and separated only by side walls for ease in fabrication. The opening permits the molding of the flowerpot holder by an insert in the die that forms the downwardly extending tongue 50 at a different level but parallel to the flat wall section 70.

Within the separating section 56 but below the level of the bottom of the tongue 50 are the three apertures in the flat wall section 70 for: (1) a screw (72 in FIG. 3); and (2) two belt or cord apertures (74 and 76 in FIG. 3) on opposite sides of the screw 72 adapted to receive the belt 34. The opening between the sides is sufficient in size to permit a die part to form the tongue 50 when molding. The base 30 includes a vertical flat plane extending parallel to a supporting post or the like and side walls, with the side walls generally having a depth of three-eighths inch to the surface 70 and a total depth of five-eighths inch. They are approximately three sixteenth inch thick. The width of the base is approximately 1.25 inches and its length is approximately eleven inches. The cross wall 71A is perpendicular to the flat wall 70 and side walls 70A (FIG. 4) and 70B.

The saucer holder section 44 includes an integral extension of the wall 70 and perpendicular dividing walls 71B–71F, a central opening 102 extending longitudinally along the wall 70 and apertures 110, 112 and 114. The central opening 102 is a slot that may receive the saucer holder 32 at a selected location. The apertures 110, 112 and 114 are similar to the apertures 72, 74 and 76 (FIG. 3) and cooperate with them to mount the hanger 18. Near the bottom of a separating section 44 are a central screw receiving aperture 110 to receive the screw or other fastener 40 and side apertures 112 and 114 to receive the belt or other tie member 36.

The saucer section 32 includes a top 80, a bottom 82, a tongue 84 and a saucer spacing section 86. The saucer spacing section 86 extends the length of the saucer holder 32 from the top 80 to a bottom surface 92 and includes two flat elongated bases 96A and 96B one under the other designed to fit within the elongated groove or central opening 102 slidably but having sufficient surfaces to provide stability. Tapped holes extend through the bases to receive fasteners 104A and 104B to hold the saucer holder 32 in place against the base and to provide fastening at a fixed location adjusted in accordance with the height of the flowerpot to be held so that the saucer held by the saucer holder 32 is adjacent to the bottom of the flowerpot held by the flowerpot holder 31.

The downwardly extending tongue 84 extends from the distal end of the top 80 vertically downwardly toward the bottom 82. The bottom 82 includes a flat top horitzontal surface 90, a slanting surface 94 and a bottom surface 92 longer than the top surface 90 to provide an angle to the slanting surface 94 sufficient to hold the saucer vertical under the flowerpot. The distal end of the tongue 84 has an inner surface within a plane offset a distance 88 from the horizontal flat surface 90 of the bottom 82 where it begins to curve downwardly to the slanted joining section 94 by an amount sufficient to receive the lip of a saucer 20 (FIG. 1). The horizontal top surface 90 is offset from the tip of the tongue 80 by a distance 98 also sufficient to receive the slanted lip of a saucer.

In the preferred embodiment, the distance 88 between the inner surface of the downwardly extending tongue 84 and the distal end of the top surface 90 is three sixteenths of an inch but should be between one eighth and one quarter of an inch and the distance 98 is one quarter inch in the preferred embodiment but should be a distance of between one-eighth and three-eighths inch. The angle of the outer end of the surface 94 is 30 degrees from the horizontal slanting inwardly toward the base. On the other hand, the angle of the slant surface 62 for holding the flowerpot is approximately 78 degrees from the horizontal slanting inwardly toward the base. However, the slant surface 94 should be in the range of between 25 and 35 degrees and the slant surface 62 should be in the range of 76 to 80 degrees.

Figure 3:
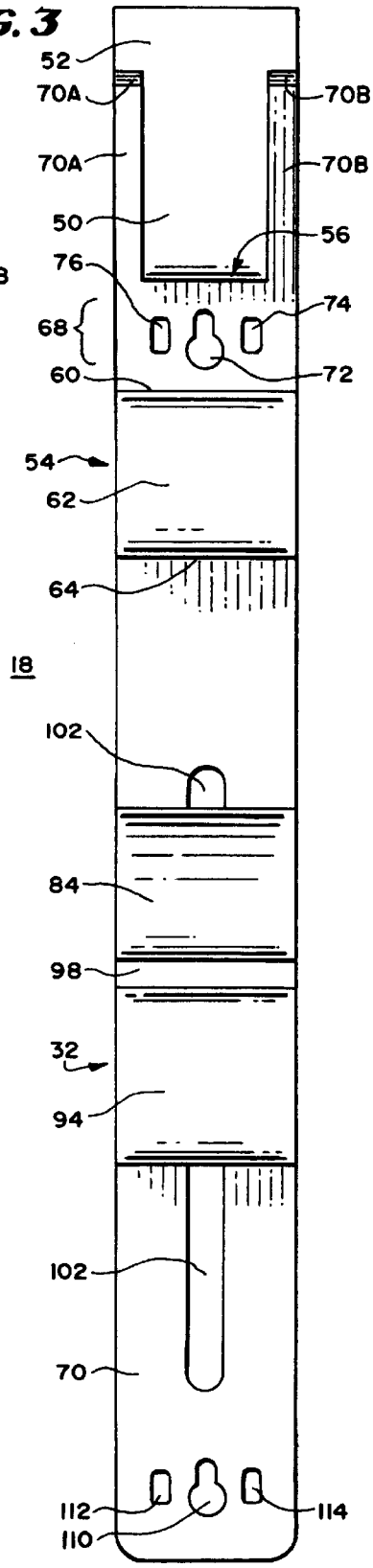
FIG. 3 is a front elevational view of a base and upper holder portion of the embodiment of FIG. 1.

In FIG. 3, there is shown a front elevational view of the hanger 18 showing the wall 70, the two apertures 74 and 76 for the upper belt 34 (FIG. 2), the lift screw aperture 72 to accommodate the upper screw 38 (FIG. 2) for hanging the hanger, belt apertures 112 and 114 for the lower belt 36 (FIG. 2) and the lift aperture 110 for the lower screw 40. The end of the tongue 50 is separated from the top surface 60 of the bottom portion 54 of the clay flowerpot holder 31 by the distance 68 and underneath the tongue 50 (not visible) is the open section in the wall 70.

The side walls 70A and 70B extend the full length of the hanger perpendicular to the wall 70 and are intersected by the sections 71A–71F (FIG. 2) perpendicular to both side walls to form a solid structure which may be mounted to a post or a portion of a building or the like. As best shown in this view, the slot 102 extends longitudinally for positioning of the saucer holder 32 in any of a plurality of positions movable along the slot. It is four and one-quarter inches long in the preferred embodiment but should be in the range of one inch to ten inches long. It is one-eighth inch wide in the preferred embodiment but should be in the range of one-sixteenth inch to one-half inch.

Figure 4:
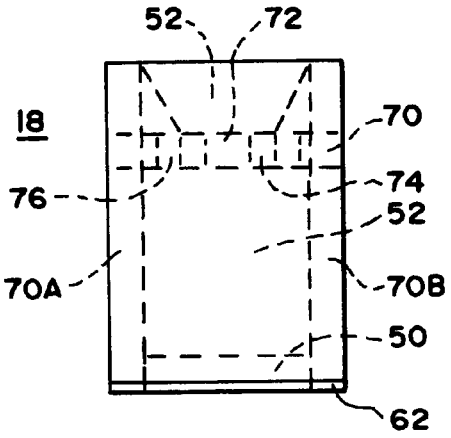
FIG. 4 is a plan view of the embodiment of FIG. 3.

In FIG. 4, there is shown a top view of the hanger 18 showing the slant surface 62 extending downwardly beyond the top portion 52 and the tongue 50 which extends downwardly toward it. As shown at 52, the openings 72, 74 and 76 pass through the wall 70 to hold the hanger 18 against a structure.

Figure 5:
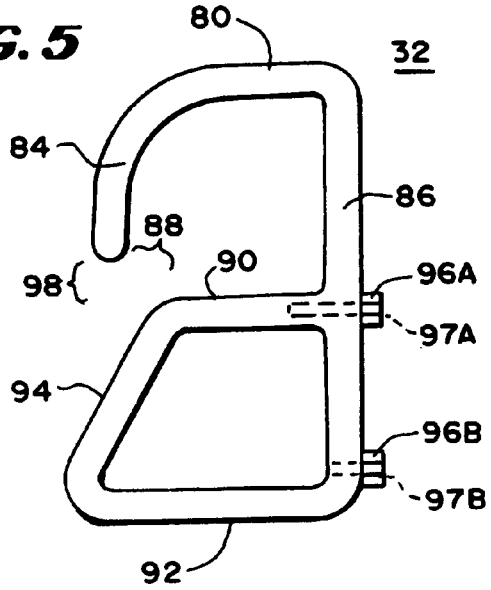
FIG. 5 is a side elevational view of a bottom hanger portion of the embodiment of FIG. 1.

In FIG. 5, there is shown a side view of the saucer holder 32 showing the flat bases 96A and 96B with central corresponding apertures 97A and 97B extending through the flat bases 96A and 96B and the separating wall 86 of the saucer holder 32. These members can be moved up and down the groove 102 (FIGS. 2 and 3) to position the saucer holder 32 and then fastened in place by the screws 104A and 104B (FIG. 2).

Figure 6:
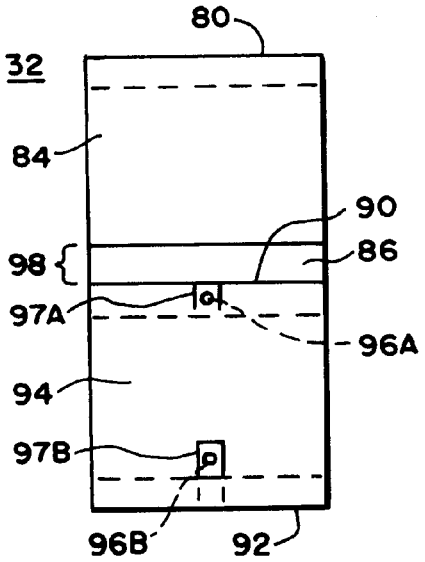
FIG. 6 is a front elevational view of the bottom hanger portion of FIG. 5.

In FIG. 6 there is shown a front elevational view of the saucer holder 32 of FIG. 5 showing the spacing 98 between the top surface 90 and the downwardly extending tongue 84 to permit the edge of a saucer to be introduced. The fasteners 96A and 96B with the central openings 97A and 97B are shown in this view extending through the separating wall 86.

Figure 7:
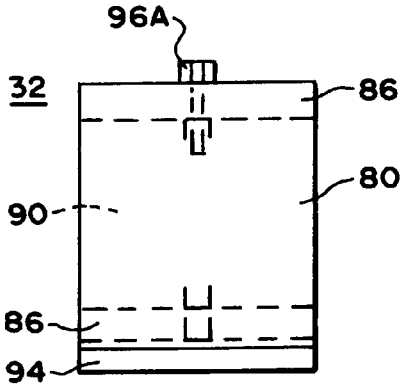
FIG. 7 is a plan view of the embodiment of FIG. 6.

In FIG. 7, there is shown a top view of the saucer holder 32 illustrating the positioning of the top 80, the horizontal surface 90 and the bottom of the slant surface 94.

Figure 8:
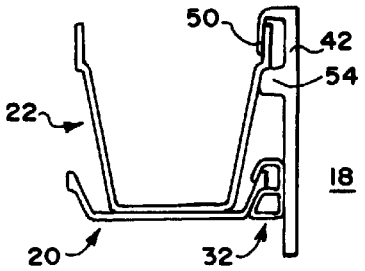
FIGS. 8–16 are schematic views illustrating the steps employed in using the invention.
Figure 9:
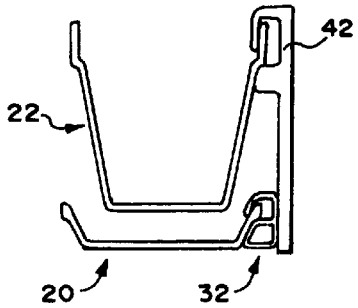

In FIGS. 8–16, there is shown a developed view of a clay flowerpot 22 and a saucer 20 being mounted to the hanger 18. As shown in FIGS. 8 and 9, the distance between the flowerpot 22 and saucer 20 is established by inserting the flowerpot 22 within the holder section 42 of the hanger 18 with the rim of the flowerpot 22 on the inner surface of the downwardly extending tongue 50 and its shoulder resting on the bottom portion 54 of the hanger 18 so that the slant surface 62 (FIG. 2) rests along the slant of the flowerpot 22.

The saucer holder 32 is mounted in place by removing the screws 104A and 104B (FIG. 2), mounting the holder in the slot 102 (FIG. 3) with the flat members 96A and 96B within the slot for alignment. The screws are then loosely inserted and the saucer moved as shown in FIG. 8 against the bottom of the flowerpot. The proper location of the saucer holder is marked at a level with a pencil and lowered as shown in FIG. 9 and then the two removed. After that is done, the holder for the saucer is moved back in place and the screws tightened.

Figure 10:
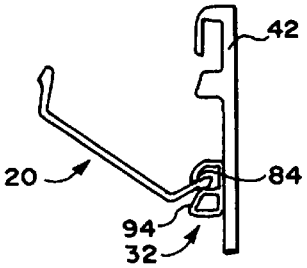

To put the saucer 20 in place, the saucer is first inserted into the saucer holder 32 before the flowerpot 22 is inserted into the upper holder 31 by inserting the edge as shown in FIG. 10 and then moving it downwardly so the slanted edge of the saucer fits against the sloped edge 94 of the saucer holder 32 with the circumferential edge resting against the tongue 84 so that the saucer is horizontal.

Figure 11:
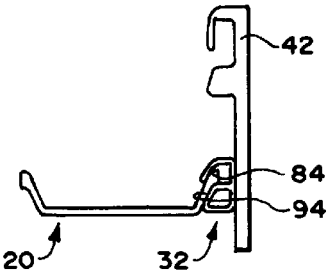
Figure 12:
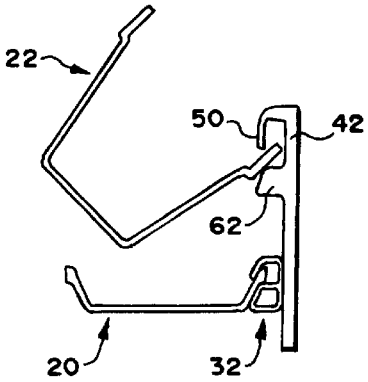
Figure 13:
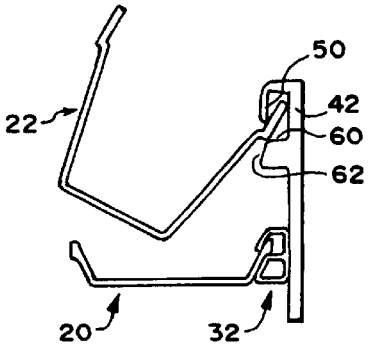
Figure 14:
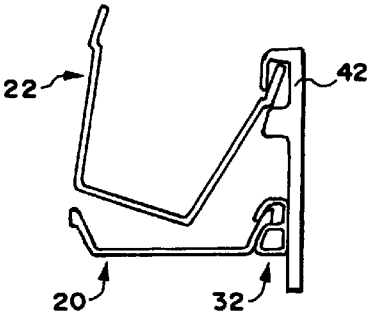
Figure 15:
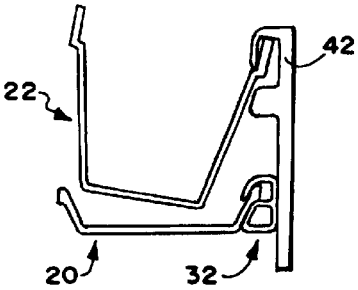
Figure 16:
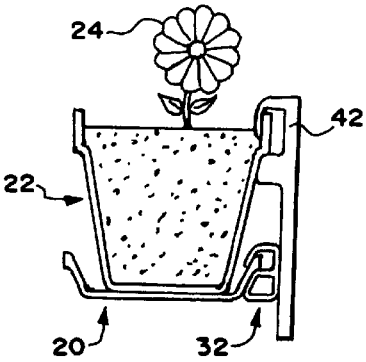

After the saucer is inserted as shown in FIG. 11, the flowerpot 22 is inserted within the flowerpot holder 31 as shown in FIG. 12 and moved downwardly in an arc as shown in FIGS. 13–15 with the bottom of the shoulder of the flowerpot 22 resting on the top surface 60, the conical slant edge of the flowerpot resting against the slanting connecting surface 62 and the inner surface of the upper rim of the flowerpot resting against the inner surface of the tongue 50. Then as shown in FIG. 16, the flowerpot, if it is not already filled, may be filled and support a growing plant.

From the above description, it can be understood that the hanger of this invention has several advantages, such as for example: (1) it may conveniently support a saucer in place; (2) it can support a plurality of different size clay flowerpots securely; (3) it is easily used; and (4) it may be economically molded.

Although a preferred embodiment of the invention has been described with some particularity, many modifications and variations in the invention are possible in the light of the above teachings. It is therefore to be understood that, within the scope of the appended claims, the invention may be practiced other than as specifically described.

What is claimed is:

1. A method of hanging a clay flowerpot to a structure comprising the steps of:

mounting a base to a surface;

mounting a flowerpot to a flowerpot holder in an upright position;

mounting a saucer to a saucer holder underneath the flowerpot and positioning the saucer with respect to the flowerpot, after which the saucer holder is fastened in place.

* * * * *